United States Patent [19]

Mathews

[11] 4,433,863

[45] Feb. 28, 1984

[54] POOL NOZZLE HEAD REMOVING AND REPLACING TOOL

[75] Inventor: Lester R. Mathews, 9810 N. 37th St., Phoenix, Ariz. 85028

[73] Assignees: Lester R. Mathews; Lucien Warner; Water Circulation Patents, ; part interest to each

[21] Appl. No.: 406,757

[22] Filed: Aug. 9, 1982

[51] Int. Cl.[3] ..... A47F 13/06

[52] U.S. Cl. ..... 294/19 R; 294/64 R

[58] Field of Search ..... 294/64 R, 19 R, 99 R, 294/20, 21, 22, 65.5; 81/1 R, 3 R, 90 R, 90 B, 90 C, 90 D, 64

[56] References Cited

U.S. PATENT DOCUMENTS 4,148,234 4/1979 Steimle ..... 294/19 R 4,218,085 4/1980 Unger ..... 294/64 R

*Primary Examiner*—James B. Marbert

*Attorney, Agent, or Firm*—LaValle D. Ptak

[57] ABSTRACT

In swimming pools the pop-up cleaning nozzles threaded into walls in the pool bottom are removable by a rotatable tool that has a body with axially extending lugs which project into corresponding openings in the nozzle head. A vacuum cup centrally of and recessed into the body attaches to the nozzle head for removing or replacing it.

2 Claims, 4 Drawing Figures

POOL NOZZLE HEAD REMOVING AND REPLACING TOOL

This invention relates to a system for attaching and removing nozzle heads from below the water level of a swimming pool and, it is an object of the invention to provide an improved system of this nature.

BACKGROUND OF THE INVENTION

Present day swimming pools are usually, if not always, equipped with pop-up nozzle heads through which water jets emit and sweep over the adjacent surface of the pool so as to keep dust and other debris in suspension. Thus such debris may be removed by the pool filtering system. These nozzles and nozzle heads function when the pool is filled with water. The nozzle heads occasionally need servicing for one reason or another and must be removed and/or replaced. This has been a relatively tedious and time consuming job, requiring that a service person go underwater to the nozzle location and remove the nozzle. Frequently this involves having the pool circulating system functioning so that the nozzle would pop-up occasionally whereupon it could be grabbed by the service person and removed such as by rotating it out of its threaded opening.

Accordingly there is a need for a tool and a system for using it whereby a service person standing at the edge of the pool can apply the tool to the nozzle head and remove it from its receptacle in the water supply conduit of the pool. Concurrently, of course, a replacement head must be attachable to the tool and thereby applied to the nozzle receptacle in the pool below the water level.

SUMMARY OF THE INVENTION

It is an object of the invention to provide a tool for removing the cleaning nozzle heads from below the water level of a swimming pool that is simple in form and efficient in operation.

It is a further object of the invention to provide an improved tool for the indicated purpose obviating the disadvantages of the prior art.

In carrying out the invention according to one form there is provided a tool for removing a member from its location comprising a body, projecting means on the body for engaging a member to be removed, and a vacuum member on the body for attachment to the member.

In carrying out the invention according to another form there is provided a system for attaching and removing nozzle heads from below the water level of a swimming pool comprising a nozzle head screw threaded into a water supply receptacle in a pool wall, diametrically spaced openings in the nozzle head, a tool comprising an essentially cylindrical body, lugs projecting in the axial direction from one side of the cylindrical body for engaging corresponding openings in such nozzle head, a vacuum cup disposed on the one side of the body for attachment to the nozzle head when the body is pushed toward the nozzle head and the lugs are received in the openings, and an elongated handle attached to the body on the side opposite to the vacuum cup.

BRIEF DESCRIPTION OF THE DRAWINGS

For a better understanding of the invention reference should be had to the accompanying drawings in which.

DESCRIPTION OF THE PREFERRED EMBODIMENT

Figure 1:
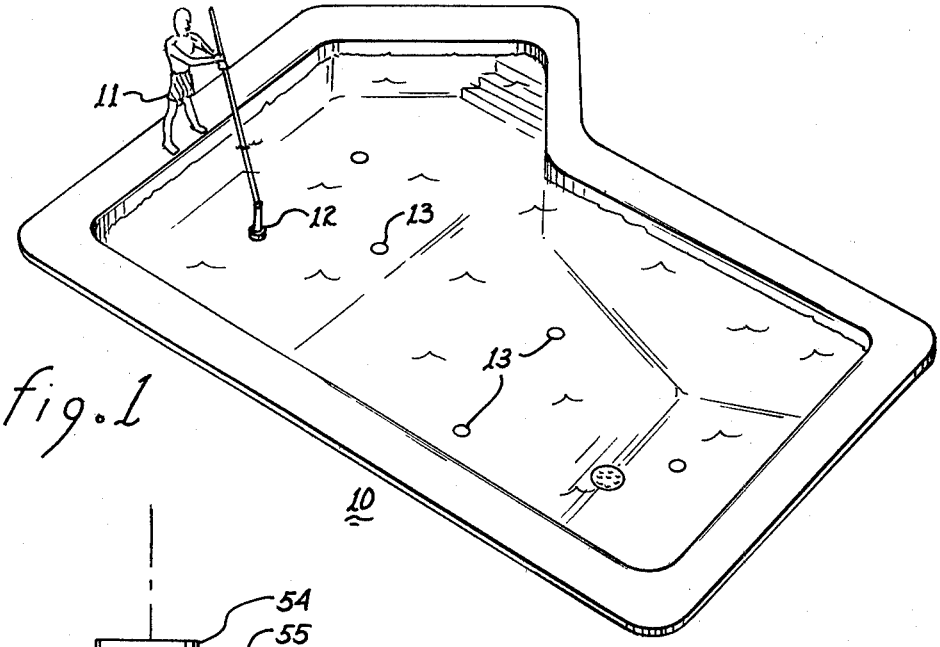
FIG. 1 is a diagrammatic view in perspective of a swimming pool equipped with pop-up nozzles for utilization with the present invention.

Referring to the drawings, the invention is shown embodied in a swimming pool 10 shown diagrammatically with an attendant 11 utilizing a tool 12 according to the invention to operate upon pop-up nozzles 13 a number of which are shown in the bottom of the pool.

Figure 2:
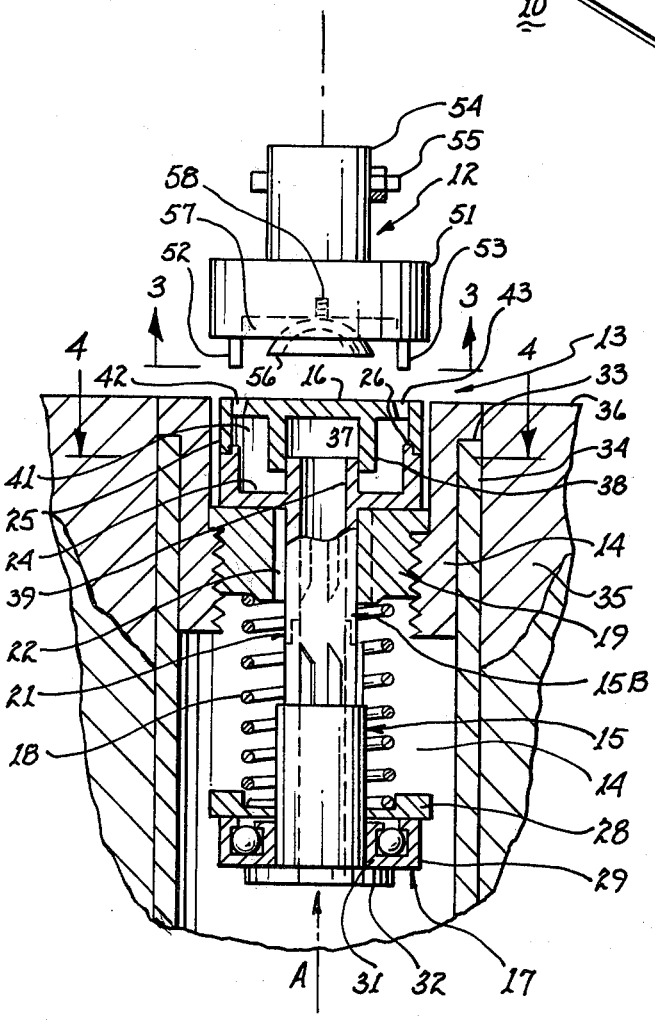
FIG. 2 is a sectional view illustrating the inventive tool and nozzle.
Figure 3:
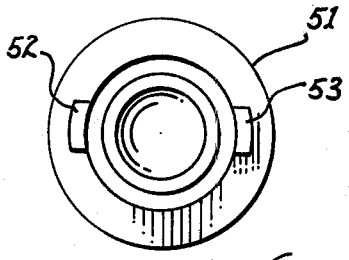
FIG. 3 is a view taken substantially in the direction of arrows 3—3 of FIG. 2.

Referring to FIG. 2, the pop-up nozzle 13 is shown in sectional view and, in general, conforms to the disclosure of pop-up nozzles in application Ser. No. 06/268,469 filed May 29, 1981 for Improved Pop-Up Indexing Nozzle Heads in the name of the same inventor as the present application. For a full disclosure of the nozzle, reference may be made to the said application. For purposes of this application, briefly, the nozzle 13 comprises a housing 14, a plunger 15, a flat-topped nozzle cap 16, a bearing 17, a spring 18 and a plunger guide support 19 assembled together as illustrated.

Figure 4:
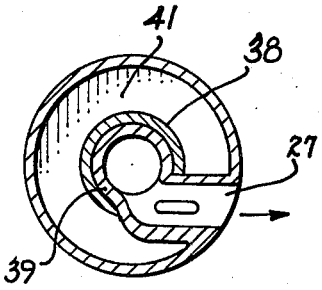
FIG. 4 is a sectional view taken substantially in the direction of arrows 4—4 of FIG. 2.

As may be seen in FIG. 2, the plunger 15 is a hollow tube having a lower part 15A and an upper part 15B joined together interfittingly at 21. The plunger 15 (parts 15A and 15B) project through a cylindrical opening 22 in the center of the plunger guide support 19. The upper part 15B of the plunger 15 extends into and becomes part of the lower half 24 of the nozzle cap 16 and is joined to the upper half 25 of the nozzle cap 16 at a juncture 26. The two parts of the plunger may be sealed together to form a unit. The upper half 24 and the lower half 25 forming the interior of the nozzle cap 16 provide a passageway or nozzle opening 27 for a water jet to emit as may be seen best in FIG. 4. The upper side of the plunger guide support 19 is engaged by the undersurface of the lower half 24 of the cap 16, the spring 18 bears against the undersurface of the plunger guide support 19, the other end of the spring 18 bears against the bearing ring 28 which in turn bears against the race 29 of the bearing 17. The other race 31 bears against a flange 32 forming one end of the plunger's lower half 15A.

The housing 14 has an interior shoulder to which is threadedly attached the periphery of the plunger guide support 19. By virtue of these threads the nozzle structure, as described, is held in the assembled position as shown. The housing 14 may include a shoulder 33 which bears against the upper edge of a pipe or conduit 34 for holding the nozzle assembly in a well provided by the conduit. The conduit 34 is held in the pool wall 35, for example, which has a surface 36 that the jet emitting from the nozzle is intended to clean. The housing 14 may be held within the end of conduit 34 by an appropriate means such as cement, for example. The housing 14 may be formed of nylon, for example, and the conduit 34 may be formed of any synthetic materials such as polyvinylchloride.

The cap 16 of the nozzle is hollow as may be seen in the figures and from the interior 37 of the nozzle cap there extends the nozzle or jet opening 27. As may be seen in FIG. 4 the jet opening 27 is laterally displaced relative to the axis of the plunger 15, and thus whenever water is emitting from the nozzle opening the nozzle rotates under the influence of the emitting jet. The interior of the upper portion 25 of the nozzle cap 16 includes a depending or skirt-like portion 38 which extends over the upper end 39 forming an extension of the plunger 15. The arcuate skirt-like portion 38 and the upper end 39 interfit with each other to form a passageway to the jet opening 27, so that any liquid interiorly of the plunger 15 does not escape into the outer portion 41 interiorly of the nozzle cap 16.

Formed into the upper wall of the nozzle cap 16 are a pair of openings 42 and 43. The openings 42 and 43 are shown projecting through the wall of the cap 16 and communicate with the space 41 inside of the upper portion 25 of the nozzle cap. The openings 42 and 43 need not be of this depth as will become clear. However their communication with the interior space 41 of the cap does not permit water to escape therethrough because this space is sealed from the interior of the plunger 15 as has been described.

As will be understood, when water pressure is applied to the nozzle 13 as shown by the arrow A (FIG. 2) the nozzle pops up and water emits through the jet opening 27. The pop up takes place against the force of spring 18. But when the water pressure is removed the force of spring 18 forces the nozzle 13 down into the position shown.

As may be seen from FIG. 2 removal of the nozzle 13 requires that the plunger 15 be rotated out of the well into which it exists by means of the threads shown. This of course can be achieved, as has been the case in the past, by applying water pressure to cause the nozzle to pop up so that it can be grabbed by hand and thereafter rotated.

According to the subject invention the tool 12 simplifies this procedure greatly and enables the nozzle to be removed without the necessity of a person going underneath the surface of the water and without applying water pressure to cause the nozzle to pop up.

The tool 12 may comprise a cylindrical body 51 from one end of which project in the axial direction a pair of tabs or lugs 52 and 53. The lugs 52 and 53 are of an appropriate size and length and are disposed so as to easily fit into the openings 42 and 43, respectively, in the nozzle cap 16. Projecting upwardly from the other end of the body 51 is a shank 54, through which extends a bolt 55 by means of which an elongated handle, for example, may be attached as may be visualized in FIG. 1. Thus rotating the handle and consequently the shank 54 and the body portion 51, (the lugs 52 and 53 having been engaged in the openings 42 and 43) causes the nozzle cap 16 and the plunger 15 to rotate. This rotation, by means of the threaded connection, causes the plunger to be moved upwardly and out of the opening or well in which it exists inside of the housing 14 and the conduit 34.

The plunger 15 may be lifted out of the pool by a vacuum cup 56 is attached to an interior cylindrical recess 57 in the body 51. The vacuum cup 56 may be of any well known variety essentially semispherically shaped and made of soft flexible material such as rubber or of the various synthetics and is attached to the interior of the body 51 by any well known means such as a screw 58.

By pushing downwardly on the body 51 by means of the shank 54 and any handle attached thereto, the vacuum cup 56 comes into contact with the smooth upper surface of the nozzle cap 16. By pushing downwardly additionally the air and water are forced out of the space inside of the vacuum cup and the vacuum cup engages the upper surface of the nozzle cap. Then when the body 51 has been rotated sufficiently to cause disengagement of the threads the vacuum cup 56 enables the nozzle plunger 15 to be lifted out of its opening. In this manner it is not necessary during the course of servicing the nozzle to go into the pool, to the site of the nozzle and work on it at that point. Replacement of a nozzle is effected by the reverse procedure.

Very substantial efficiencies and advantages are thereby achieved.

I claim:

1. A tool for removing a nozzle head having a substantially flat top surface from below the water level of a swimming pool in which said nozzle head is rotatably connected into a water supply receptacle and has spaced openings on the top surface thereof, said tool comprising a substantially cyclindrical body with first and second ends, lugs projecting in the axial direction from the first end of said cylindrical body for engaging the corresponding spaced openings in said nozzle head, a vacuum cup made of resilient material disposed on the first end of said body between said lugs for attachment to said nozzle head when said body is pushed toward said nozzle head and said lugs are received in the openings in the top surface in said nozzle head, and an elongated handle attached to the second end of said body for rotating, lifting, and replacing said head.

2. A system for attaching and removing nozzle heads from below the water level of a swimming pool comprising a nozzle head screw threaded into a water supply receptacle in a pool wall, diametrically spaced openings in said nozzle head, a tool comprising an essentially cylindrical body, spaced apart lugs projecting in the axial direction from one end of said cylindrical body for engaging corresponding ones of said diametrically spaced openings in said nozzle head, a vacuum cup disposed between said lugs on said one end of said body for vacuum attachment to said nozzle head when said body is pushed toward said nozzle head and said lugs are received in said openings, and an elongated handle attached to said body on the end opposite to said vacuum cup.

* * * * *